United States Patent [19]

Chambers et al.

[11] 3,978,676

[45] Sept. 7, 1976

[54] SHIP LIFTING APPARATUS

[75] Inventors: Henry B. Chambers, Santa Inez; Clair W. Tellefson, Santa Barbara; Tony H. Balsillie, Goleta, all of Calif.

[73] Assignee: Hydranautics, Goleta, Calif.

[22] Filed: Oct. 28, 1975

[21] Appl. No.: 626,078

[52] U.S. Cl. ..... 61/65

[51] Int. Cl.[2] ..... E02C 5/00; B66B 9/04; B63C 5/00

[58] Field of Search ..... 61/65, 9; 214/1 A; 187/1 R; 114/44, 48

[56] References Cited

UNITED STATES PATENTS

| | | | |
|---|---|---|---|
| 481,411 | 8/1892 | Moran | 61/65 |
| 1,061,213 | 5/1913 | Arbuckle | 61/65 |
| 3,791,229 | 2/1974 | Liedtke | 61/65 X |

*Primary Examiner*—Jacob Shapiro
*Attorney, Agent, or Firm*—Clement H. Allen

[57] ABSTRACT

A ship lifting apparatus, or drydock, is formed by a pair of parallel, spaced apart piers which define a slip in which is located a platform on to which a ship can be floated. The platform is raised or lowered by a plurality of chain jacks mounted in aligned rows on each of the piers. One of the chain jacks is a master jack and has chain link-engaging latches controlled by a cam and follower while the other chain jacks are slave jacks being actuated by connection to each other and the master jack by tensioned cables attached to their latch actuating mechanisms.

12 Claims, 18 Drawing Figures

116
118
114
112
110
108
96
92
32
48
74
76
80
84
200
198
202
196
106
194
192
130
32a
94
102
98
190
104
182
180
188
184
186

SHIP LIFTING APPARATUS

BACKGROUND OF THE INVENTION

1. The Field of the Invention

This invention relates to a ship lifting apparatus, or drydock.

2. The Prior Art

Many arrangements have been used and proposed by the prior art for docking vessels or lifting them out of the water for purposes such as repairs and under-body painting and servicing. These arrangements have included a platform between a pair of spaced apart piers and which is first submerged and the vessel floated onto it. The platform and the vessel are then lifted out of the water by raising the platform by means of various hoisting mechanisms mounted on the pier edges. One such drydock raises and lowers the platform carrying the vessel by electrically rotated drum hoists mounted on fixed structures on both sides of the platform and connected to the platform by wire rope cables. A number of such hoists may be employed in a row on each side of the platform, each hoist having an electric driving motor, a cable drum, often a reduction gear and some sort of a brake.

Problems arise with wire cable hoist drydocks because the life of the wire rope cables is short due to the heavy loads carried and the deformation which occurs in travel over drums and pulleys. In addition, the electric driving motors for the drum hoists must be carefully synchronized to provide uniform lift. This may be difficult if the cables stretch appreciably or nonuniformly. The braking system also must be carefully designed to hold the very heavy load safely at any level.

A substantial improvement would be made by providing a ship lifting apparatus which employed lifting mechanisms that do not stretch appreciably, which have long life, and which can be safely and mechanically locked to provide a fail-safe braking system.

BRIEF SUMMARY OF THE INVENTION

The invention comprises a ship lifting apparatus or drydock in which a pair of spaced apart piers define a slip in which is arranged a platfrom adapted to support a ship or vessel. A plurality of chain jacks are mounted in a row on each of the piers and have the bottom ends of their lifting and lowering chains attached to the platform. Each chain jack has a base mounted at the edge of a pier and hydraulic cylinder for moving a ram reciprocally and repetitively with respect to the base, and latches operatively attached to the base, and to the ram, for engaging and disengaging links of the chains.

The latches attached to the rams of the jacks and the latches attached to the bases of the jacks are respectively connected to each other by stressed cables which are moved back and forth to actuate the ram latches and the base latches respectively in unison. One of the jacks is a master jack having a cam and follower control for moving its latches in and out of engagement with its chains at predetermined positions of its ram relative to its base during reciprocal repetitive movement of these elements. Since the latches of the other jacks, that is the slave jacks, are all connected to the latches of the master jack, these also move in and out of engagement with their chains at positions of their rams and bases synchronized with those of the master jack. The latch connecting cables are connected at each of their ends to hydraulic cylinders which are themselves interconnected to maintain each cable under tension while enabling it to move back and forth under control of the master jack. Centrally pivoted rocker arms having their ends bearing on end elements of each of the ram and base stressed cable assemblies ensure that only one of the ram latches or the base latches of the jacks can be disengaged from the chains at any time. Since only one of the jacks is a master jack and all the other jacks are synchronized with it, the rows of jacks on each of the piers are automatically synchronized in operation, and even and steady lifting of a ship load can be accomplished.

DESCRIPTION OF A PREFERRED EMBODIMENT

Figure 1:
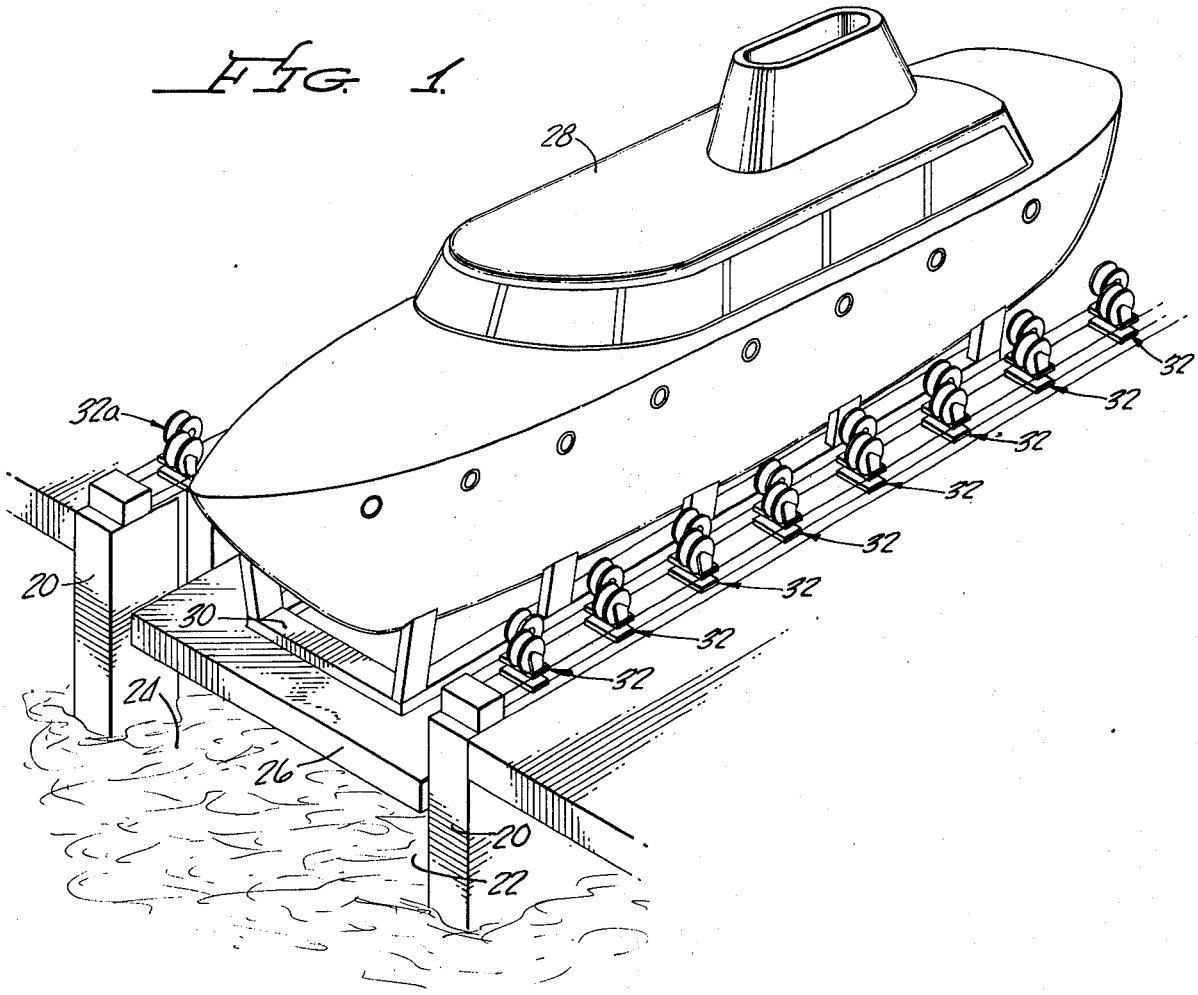
FIG. 1 shows a general perspective view of ship lifting apparatus embodying features of this invention.

Referring first to FIG. 1, the ship lifting apparatus or drydock of this invention comprises a pair of parallel and spaced apart facing piers 20 which between them define a slip 22. Piers 20 will be arranged so that their lower ends are submerged in water 24 to a sufficient depth so that a ship or vessel in slip 22 will initially be afloat. Spanning slip 22 with sufficient clearance at each side so as to be readily raised or lowered therein is platform 26 which should be of sufficiently heavy and strong construction to support a vessel 28 which may be securely supported on platform 26 by a suitable cradle structure 30.

Figure 6:
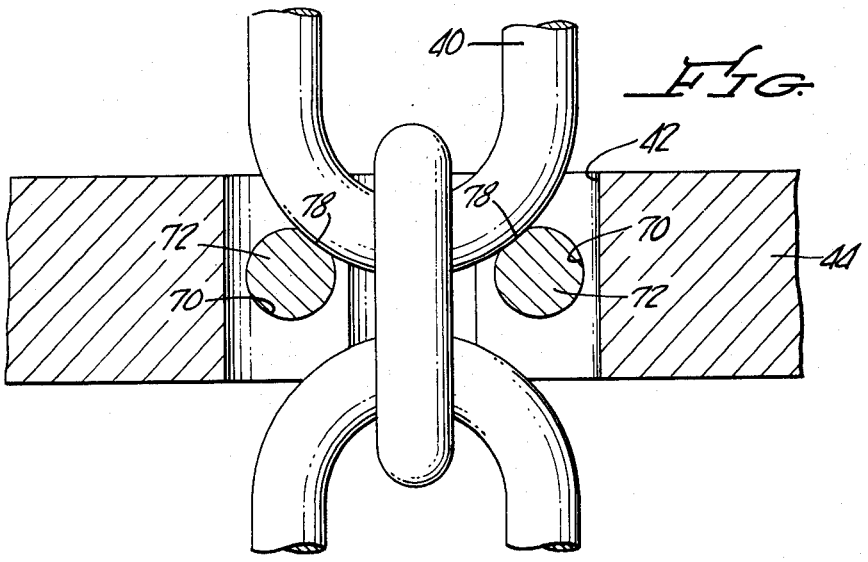
FIG. 6 shows an enlarged portion in vertical section of a latch plate seen in FIG. 5 taken along the line 6—6.

Along the top edge of each of piers 20 is mounted an aligned row of chain jacks 32 of size, number and spacing to raise and lower platform 26 together with its vessel 28. Each of jacks 32, as will be seen more clearly in FIGS. 2 and 3, comprises a base 34 having extensions 36 adapted to rest and be fastened on recessed ledge 38 in the edge of pier 20 and securely fastened thereto by bolts 39. Each jack is preferably of the double chain type as shown and having a pair of chains 40 each of which pass through a cruciform aperture 42 in a lower latch plate 44 (as will be seen more clearly in FIGS. 4, 5, and 6), and through a similar aperture 42 in an upper latch plate 46. Cruciform apertures 42 in lower latch plate 44 and upper latch plate 46 are arranged in vertically aligned pairs on each side of a central hydraulic cylinder 48 having a piston 50 to which is attached a connecting rod in the form of upwardly extending ram 52. Upper latch plate 46 is fixedly attached to the top or head of ram 52, and lower latch plate 44 is attached to jack base 34 and also to the hydraulic cylinder 48 which it surrounds. A suitable seal or gland 54 seals the ram 52 where it passes out of the end of cylinder 48 and lower latch plate 44.

Figure 2:
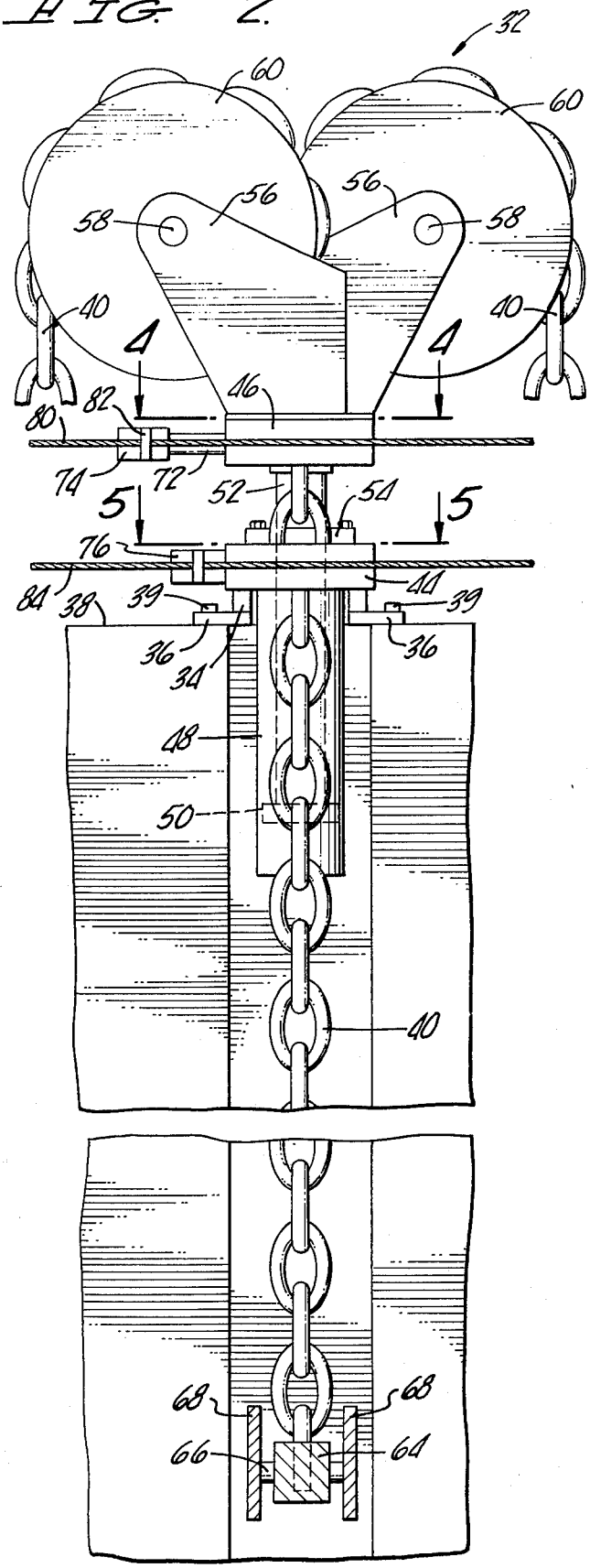
FIG. 2 shows a side view of one of the chain jacks of the apparatus of FIG. 1 mounted on one of the piers with its chain connections partly broken out.
Figure 3:
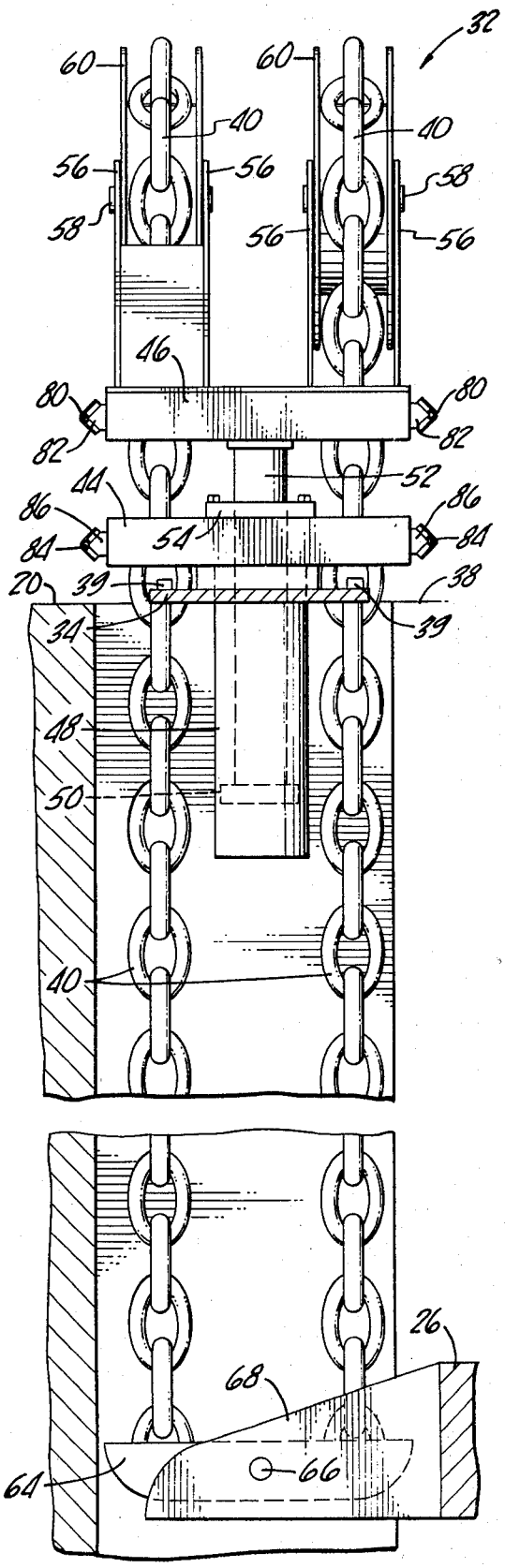
FIG. 3 shows an end view of the jack of FIG. 2, partly broken out.

On the top of upper latch plate 46, or to the ram head structure, are fixedly attached two pairs of upstanding arms 56; through bearings near the top of each pair is arranged a horizontal shaft 58 on which freely rotates a grooved sheave 60. The pair of chains 40 pass upwardly through the cruciform apertures 42 in lower latch plate 44 then through cruciform apertures 42 in upper latch plate 46 and then over the pair of grooved sheaves 60. The lower ends of each pair of chains 40, as will be seen in FIGS. 2 and 3, are attached to each end of a rocker arm 64 which is pivotably attached as by pin 66 to ears 68 which are attached to the side of platform 26.

One of jacks 32 specifically identified as 32*a* on FIG. 1, is a master jack having the same general operating features as the remainder of jacks 32 but in addition has a cam and follower control for synchronizing the action of its chain latch with the reciprocal and repetitive actuation of its ram by its driving hydraulic cylinder. The synchronization is transmitted to all the other jacks 32 (which are slave jacks with jack 32*a* being the master) through a system of stressed cables as hereinafter described in detail.

Figure 4:
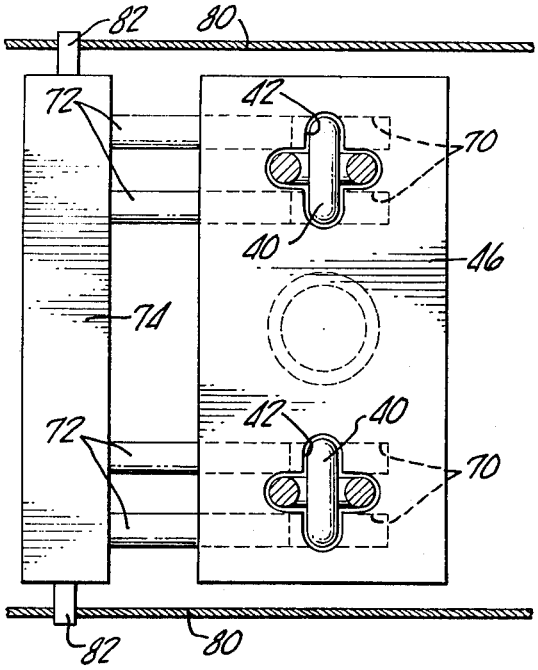
FIG. 4 shows a horizontal section of the jack of FIG. 2 taken along the line 4—4.
Figure 5:
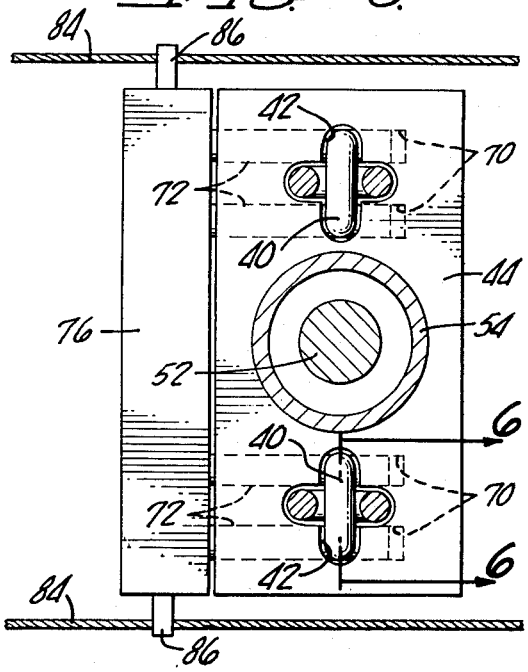
FIG. 5 shows a horizontal section of the jack of FIG. 2 taken along the line 5—5.

Each of the latch plates 44 and 46 has two pairs of horizontal bores 70, the bores in each pair being spaced apart slightly more than the small diameter of a chain link, and each pair passing through or in the way of cruciform apertures 42, through the right angle cross arm areas. In each of bores 70 is a slidable pin 72, the pins 72 in upper latch plate 46 being fixedly attached at their outer ends to latch bar 74 to comprise a ram latch, and the pins 72 in lower latch plate 44 being attached in like manner to latch bar 76 to comprise a base latch. The cross section of FIG. 4 shows ram latch bar 74 with its pins 72 retracted while the cross section of FIG. 5 shows base latch bar 76 with its pins 72 projected in its bores 70 and past cruciform aperture 42 so that these can support a link of a chain 40 passing through aperture 46 as may be more clearly seen in FIG. 6. When latch bar 74 or 76 is positioned with pins 72 retracted then a chain 40 can slide freely through aperture 42. Preferably the inner upper surfaces of each of pin 72 are flattened or slightly grooved longitudinally as at 78 in FIG. 6 to better fit the configuration of the areas of the links of chains 40 that they contact.

Figure 8:
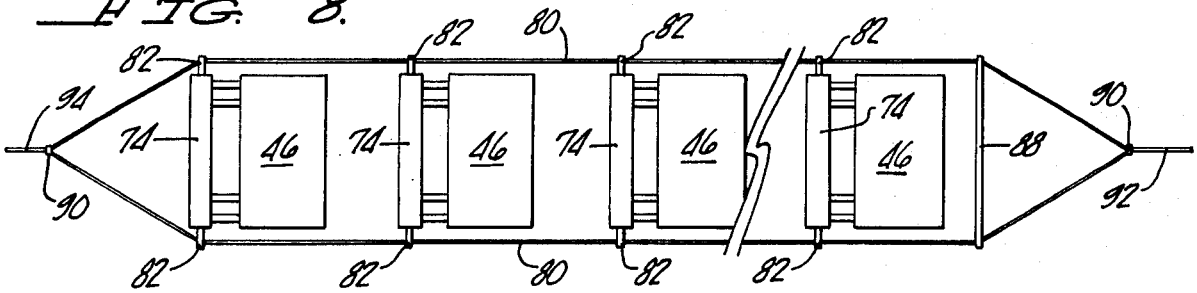
FIG. 8 shows a diagramatic top view of the cable assembly connecting the jack ram head latch bars.
Figure 9:
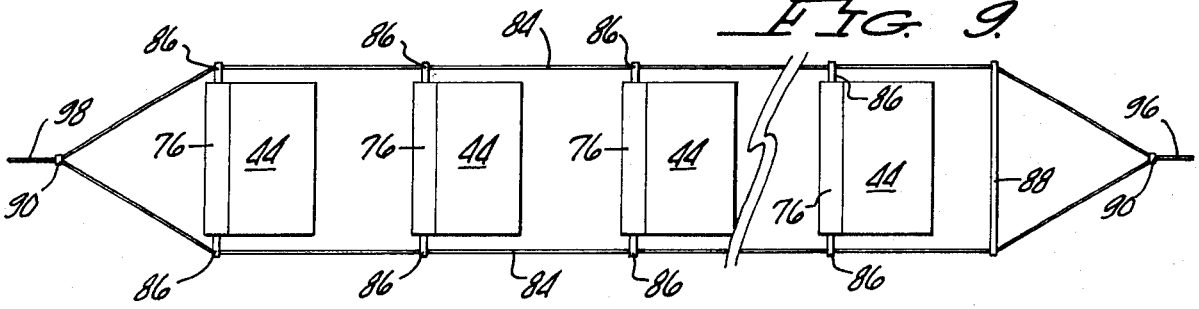
FIG. 9 shows a diagrammatic top view of the cable assembly connecting the jack base latch bars.
Figure 7:
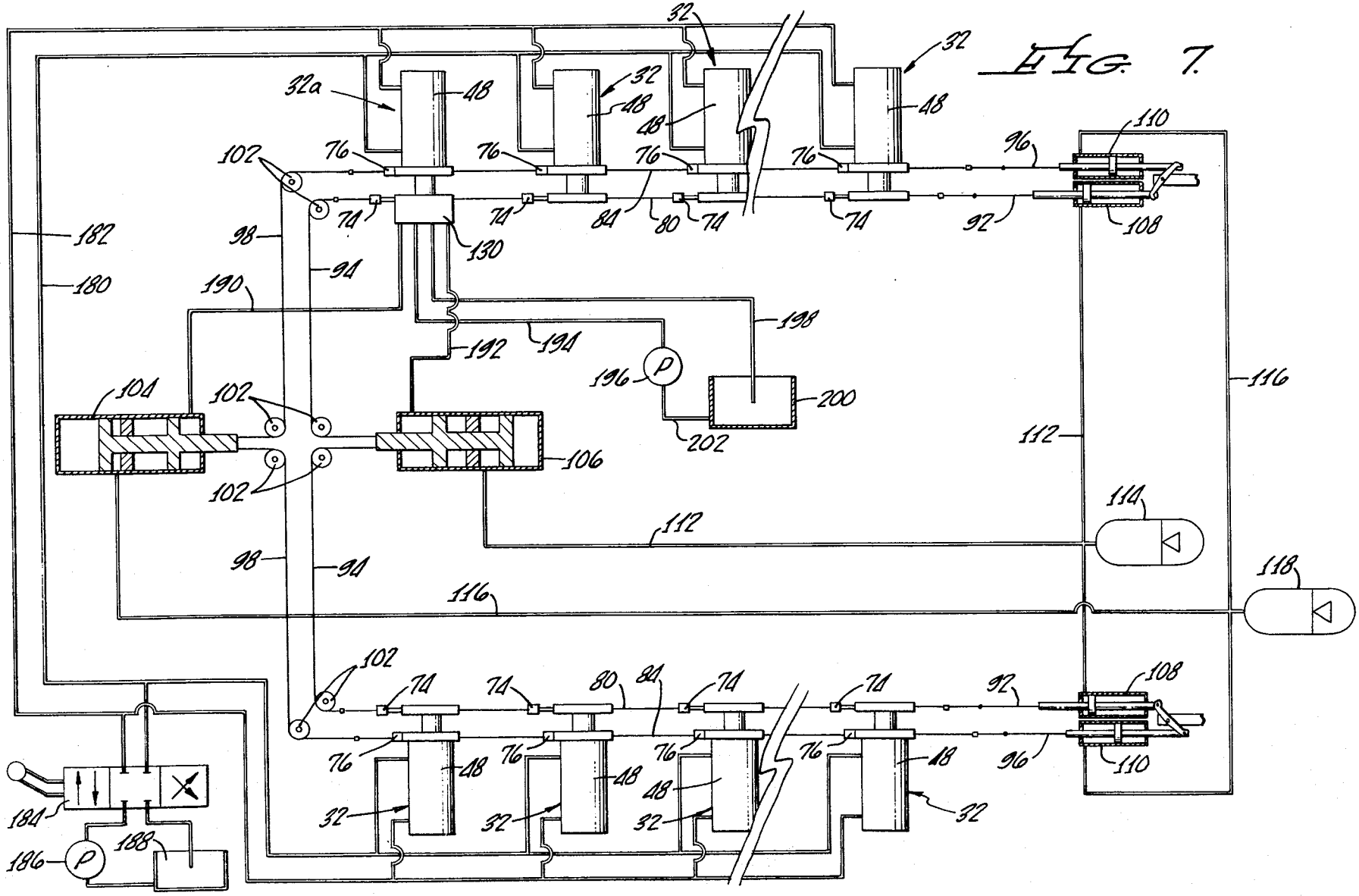
FIG. 7 shows a diagramatic view of the stressed cables connecting the latch bars of the jacks seen in FIG. 1 and their operating hydraulic cylinders.

In FIGS. 7, 8, and 9 are shown diagramatically the stressed cables connecting the ends of the latch bars 74 and 76 of the jacks 32 and 32*a*, these jacks being depicted for clarity as ram and cylinder without chains, sheaves and other parts. A stressed wire cable 80 is attached by conventional clamps as at 82 to each end of latch bars 74 which are connected to latch pins in the ram head latch plate of each jack, and a stressed wire cable 84 is clamped as at 86 to each end of latch bars 76 which are connected to latch pins in the base latch plate of each jack. In both rows of jacks 32 seen in FIG. 7 the latch pins in the ram head latch bars 74 are retracted from the latch plates 46 to disengage their latch pins 72 from the chains. In both rows of jacks 32 the latch pins 72 in the base latch bars 76 are projected into latch plates to engage their latch pins 72 with chains 40. In FIG. 8 the stressed cables 80 are attached at one end to spreader 88 and are joined as at 90 to form a bridle and attached to single cable 92. At the other end of the proximate latch bar 74 is employed as a spreader and the cable ends are joined also as at 90 to form a bridle attached to single cable 94. In like manner the cables connecting the ends of latch bars 76 are connected at one end to a similar spreader 88 and joined as at 90 and attached to a single cable 96. At the other end cables 84 are similarly joined as at 90 to a single cable 98. Reverting to FIG. 7, cables 98 from the jack base latch bars 76 pass over pulleys 102 and are attached to the piston rod of double piston hydraulic cylinder 104. In like manner cables 94 from the ram head latch bars 74 pass over similar pulleys 102 and are connected to the piston rod of double piston hydraulic cylinder 106. At the other end of the cable assemblies cable 92 from the ram head latch bars 74 is attached to the piston of hydraulic cylinder 108 and in like manner cable 96 from the base latch bars 76 is attached to the piston of hydraulic cylinder 110. Connecting the left hand (in the drawings) ends of hydraulic cylinders 108 is oil line 112 which is also connected to the oil filled side of accumulator 114 and into hydraulic cylinder 106 at the right of its left hand piston as shown. Similarly, the left hand ends of hydraulic cylinders 110 are connected by oil line 116 to accumulator 118 and to hydraulic cylinder 104 at the right of its left hand piston as shown. It will be apparent that selective operation of hydraulic cylinders 104 and 106 can cause cables 80 and 84 to move the latch bars 74 and 76 selectively to the left or right (in the drawings) to project their latch pins into or retract them respectively from latch plates 46 and 44 and thereby in or out of engagement with chains 40. Control of hydraulic operation of cylinders 104 and 106 will be explained in detail hereinafter.

Figure 10:
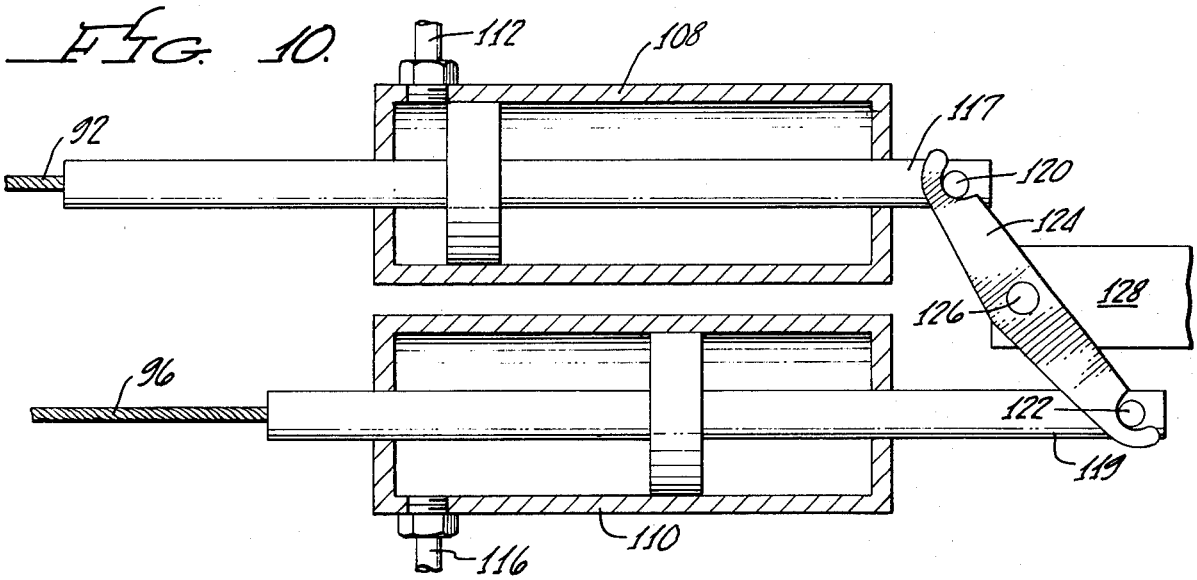
FIG. 10 shows an enlarged side view of the rocker arm safety catch at the ends of the cable assemblies seen in FIG. 7.

Hydraulic cylinders 108 and 110 connected to accumulators 114 and 118 having a compressible gas in their right hand chambers, act as hydraulic springs to maintain cables 80 and 84 and their connecting cables 92, 94, 96 and 98 always under tension during back and forth movement of latch bars 74 and 76 imparted by operation of hydraulic cylinders 106 and 104. It is an important safety feature that means are provided to ensure that at least one of the sets of latch pins, that is either those connected to ram head latch bars 74 or those connected to base latch bars 76, will be projected into their respective latch plates 46 or 44 and engaged with the links of chains 40 under all conditions of operation. At no time can the chains carrying the load, that is the platform supporting a vessel or alone, be forced from connection with one set of latch pins so that it could accidentally drop. This is accomplished in the embodiment illustrated by provision of piston rod extensions 117 and 119, as seen in the enlarged view of FIG. 10, which project from the other ends of hydraulic cylinders 108 and 110 respectively, that is the end remote from that at which cables 92 and 96 are connected to their pistons. These piston rod extensions 117 and 119 are provided with means such as upstanding pins 120 and 122, each one of which can selectively fit or mate into an indentation near each end of rocker arm 124, which is pivotably attached at its center as at 126 to a fixed and immovable support 128. Noting the positions of the latch bars 74 (in FIG. 7), it will be seen that their latch pins are disengaged from chains 40 by operation of hydraulic cylinder 106 which has moved these to the left (in the drawings) and has also moved the piston and piston rod extension 117 of hydraulic cylinder 108 to the left. As seen in FIG. 10 this has caused pin 120 of piston rod extension 117 to force rocker arm 124 to rotate so that its upper part is also moved to the left. In this position the lower pin 122 on rocker bar 124 has moved to right and in so doing maintains the set of cables 98, 84 and 96 at a right hand position or extension so that the latch pins of attached latch bars 76 are safely and immovably retained in engagement with the links of chains 40. When the jack base latch bar cables 98, 84 and 96 are moved to the left for programmed disengagement of the latch pins of latch bars 76 from chains 40, and the cables 94, 80 and 92 are programmed for engagement of the ram head latch pins with the chains, then rocker bar 124 rotates clockwise (in the drawings) to similarly prevent accidental disengagement of the ram head latch bar pins. Therefore, when one set of latch pins is withdrawn from the chain the other set is locked in safety engagement.

In FIG. 7, the length of cables 92 and 94 have been foreshortened for clarity and to make possible convenient illustration of their connection with hydraulic cylinder elements. In practice it may be preferable to employ relatively long lengths for these cables as more clearly seen in the disconnected view of FIG. 8 so that the change in cable position caused by movement up and down of latches 74 when ram 52 moves latch plate 46 up and down, results in inconsequential change in the relative cable length. Effective synchronization and latch control are thereby maintained.

Figure 11:
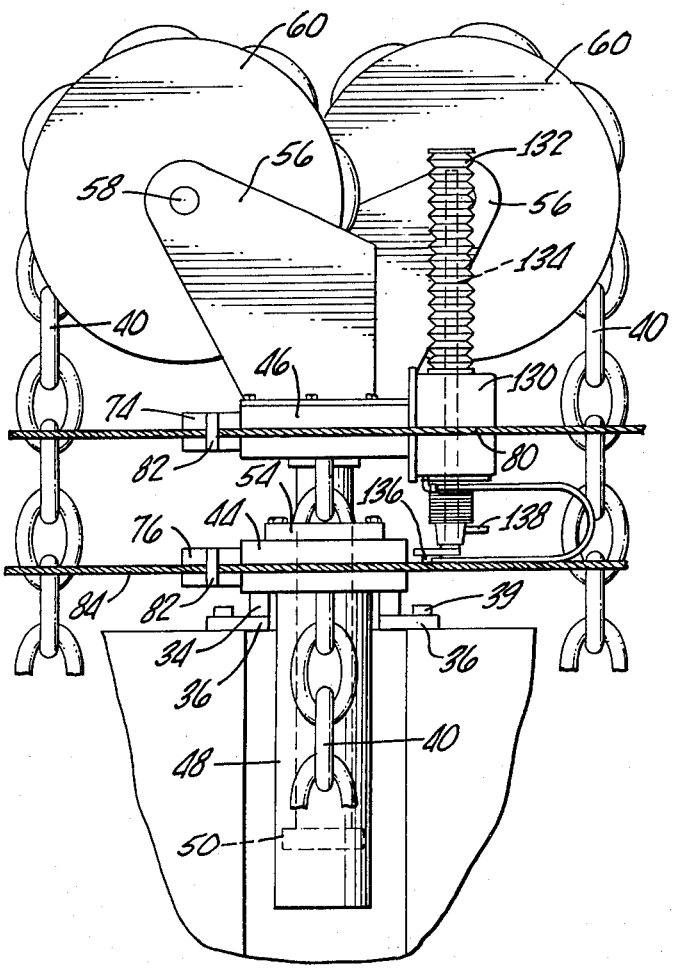
FIG. 11 shows a side view of the master chain jack.
Figure 12:
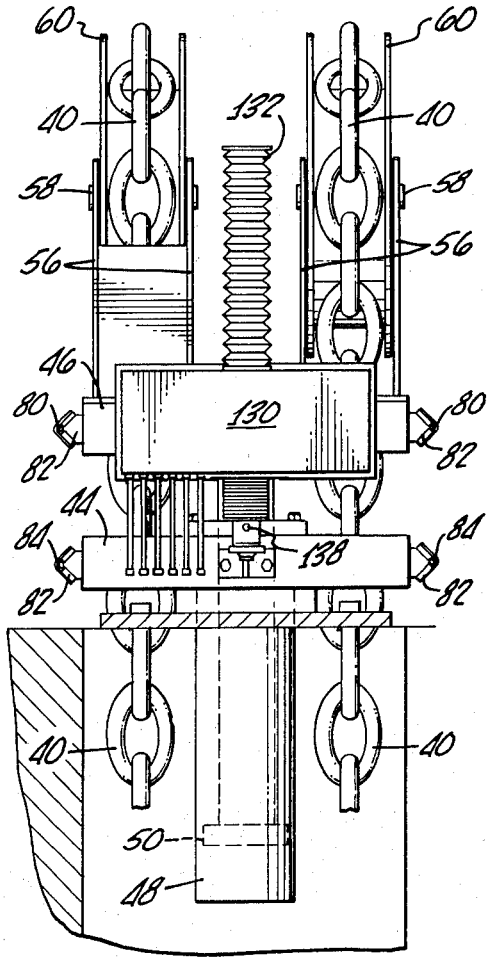
FIG. 12 shows an end view of the master chain jack of FIG. 11.

Referring now to FIGS. 11 and 12, the master jack **32*a* comprises essentially the same operating elements as slave jacks 32 and similarly identified including the upper latch plate 46 attached to the top of ram 52 and lower latch plat 44 attached to base 34 and the top of vertical hydraulic cylinder 48. Chains 40 pass through latch plates 44 and 46 and over sheaves 60. Cables 80 and 84 connecting the latch bars of the master jack 32 to the slave jacks 32 are similarly clamped to the master jack latch bars as at 82. The cam and follower latch control of master jack 32*a* is enclosed in box 130 with a bellows dust cover 132 enclosing the square cross section cam groove bar 134 which is described in detail hereinafter. Cam goove bar 134 is vertically and conventionally rotatably attached by bracket 136 to lower latch plate 44 and is provided near its lower end with handle 138** by which it may be rotated to provide desired cam and follower action for either "RAISE" or "LOWER" mode of operation.

Figure 13:
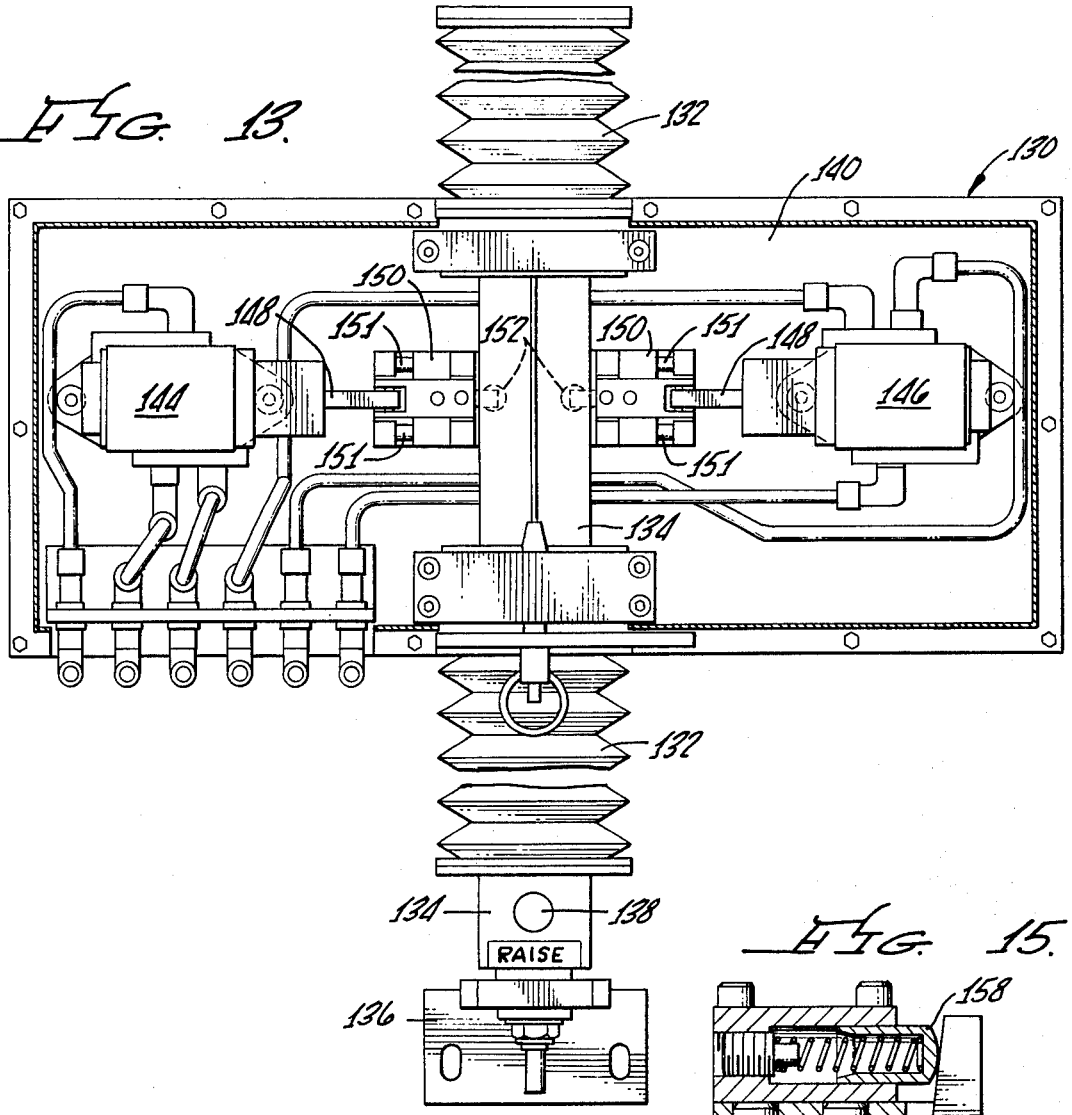
FIG. 13 shows an enlarged end view of the cam and follower arrangement employed in the master jack of FIG. 11.
Figure 15:
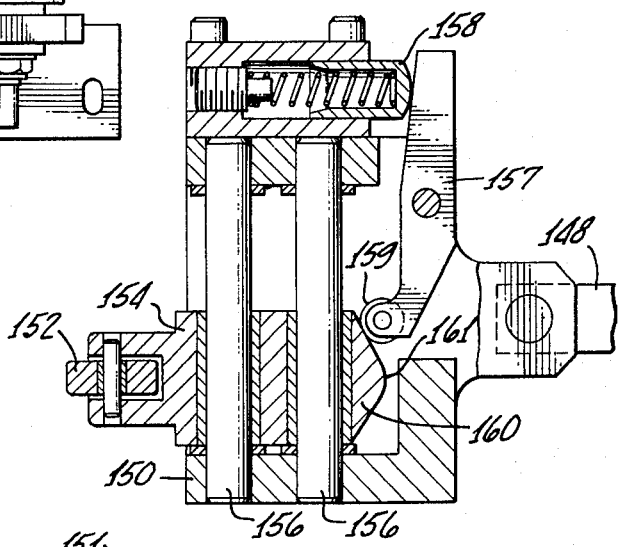
FIG. 15 shows a fragmentary top view of one of the follower mounts of FIG. 14.
Figure 14:
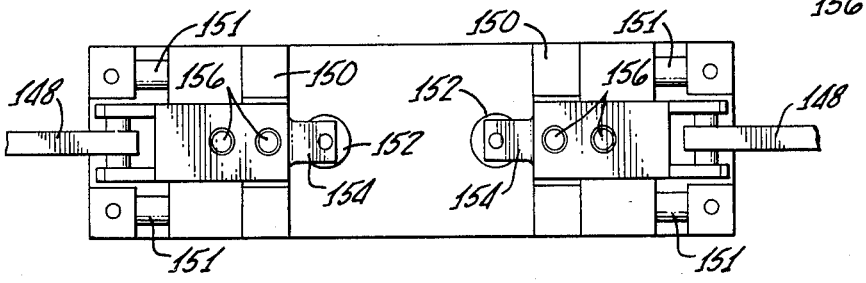
FIG. 14 shows a fragmentary end view, also enlarged, of the follower mounts employed in the cam and follower arrangement of FIG. 13.

Details of the design and operation of the cam groove bar 134 and its cooperating followers in the form of rollers will be more clearly seen in the enlarged view of FIG. 13 and FIG. 14 in which the follower connection and actuation mechanism is shown within enclosed box 130 with its cover removed. Fixedly attached to the base 140 of box 130 are three way hydraulic valves 144 and 146 which control the supply of pressurized hydraulic fluid respectively to hydraulic cylinders 104 and 106 to actuate the cables 84 and 80 to move latch bars 74 and 76 and pins 72 in and out of engagement with chains 60 at proper positions in the extension and retraction cycles of jack vertical hydraulic cylinders 48. Hydraulic valves 144 and 146 each have a projecting actuating rod 148 which is connected to a roller assembly 150 slidably mounted on rods or bars 151. Each roller assembly 150 comprises a follower in the form of rotatable roller 152 mounted at the projecting end of a holder 154 which can travel in a horizontal plane along two rods 156, to be in position to engage either of the two parallel grooves in each face of cam groove bar 134, as will be described later. Mounted also on each roller assembly 150 is a pivoted arm 157, one end of which is biased by spring rod 158 so that its other end fitted with follower wheel 159 bears against a cam 160 having a central high spot 161 and which is fixedly attached to the inner end of roller holder 154 as will be seen in FIG. 15. Pivoted arm 157 is of such length and so pivoted that its end follower 159 will be on one side of high spot 161 of cam 160 when roller 152 is riding in one of the parallel grooves in a face of cam groove bar 134, and will be on the other side of high spot 161 when roller 152 is riding in the other of the parallel grooves in cam bar 134. Rollers 152 are therefore maintained in grooves in the faces of cam bar 134 which they are programmed to follow as will be described later.

Figure 16:
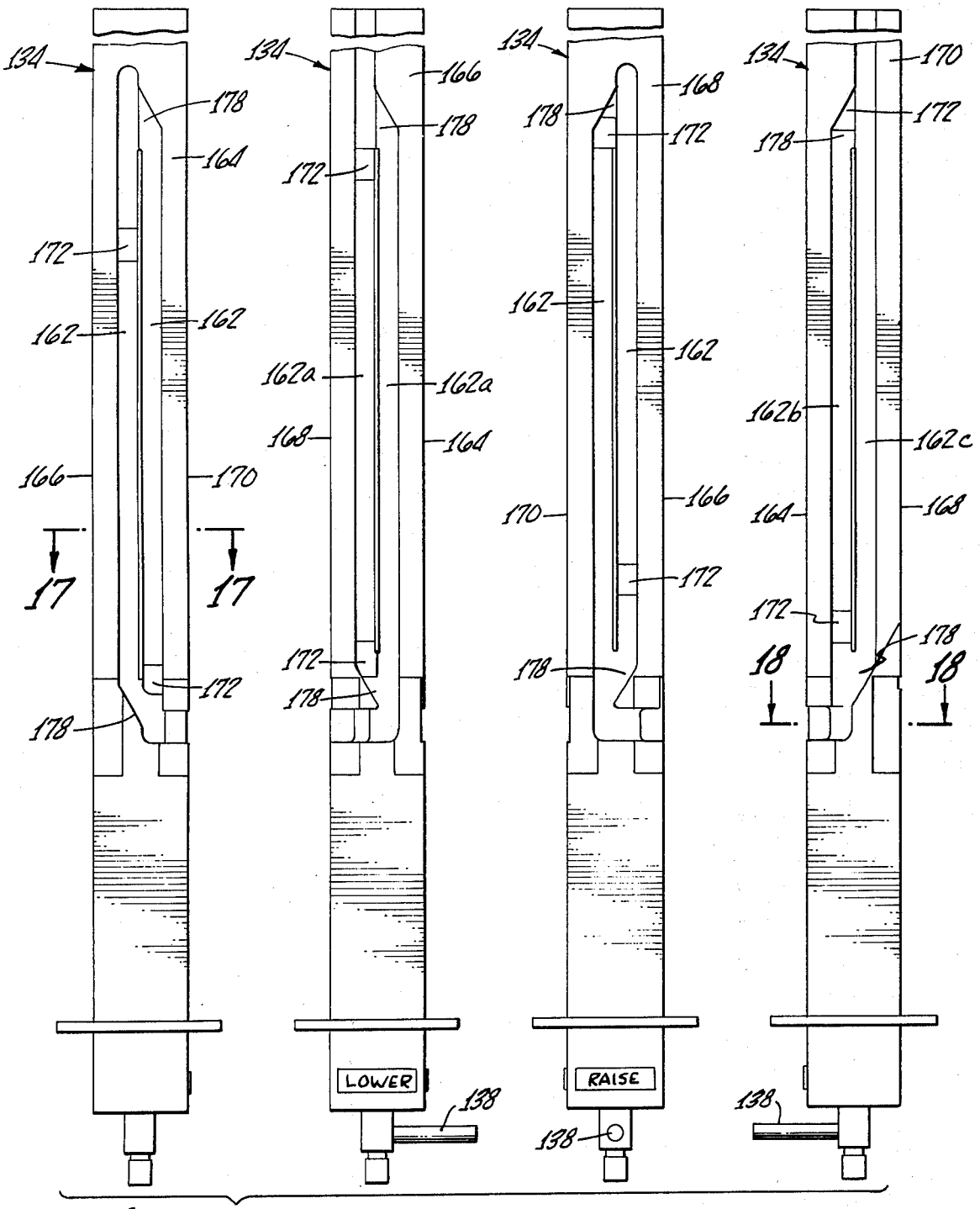
FIG. 16 shows collective views of the four faces of the cam groove bar.
Figure 17:
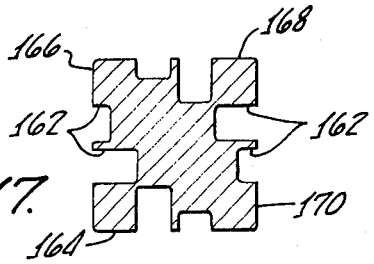
FIG. 17 shows an enlarged vertical cross section of the cam groove bar of FIG. 16 taken along the line 17—17.
Figure 18:
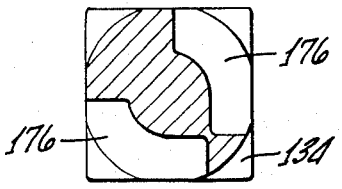
FIG. 18 shows an enlarged vertical cross section of the cam groove bar of FIG. 16 taken along the line 18—18.

Referring now to FIGS. 16 and 18 the four faces of square cam groove bar 134 are each provided with a pair of parallel and spaced apart cam grooves 162. The four faces of cam groove bar 134 are identified as 164, 166, 168 and 170 reading from left to right in FIG. 16. Thus when handle 138 is perpendicular to the plane of the drawing of FIG. 13, as shown in FIG. 13, the cam groove bar 134 will be in "RAISE" position with diametrically opposite faces 166 and 170 presented to the follower assemblies on each side and with corresponding rollers 152 engaging one of cam grooves 162 in each of these faces. As will be clear from FIG. 17 cam grooves 162 are of depth indicated as either high or low to force follower rollers 152 to actuate three way valves 144 and 146 correspondingly. Transition areas identified as 172 provide ramps to allow the rollers 152 to follow smoothly changes from high or low groove level.

Change from "RAISE" mode to "LOWER" mode may be made by rotating cam groove bar 134 90° so that the "LOWER" legend appears instead of "RAISE" as in FIG. 13, and the "LOWER" pair of cam groove bar faces will now have their cam grooves engaged with rollers 152 of roller assemblies 150. In the examples shown in FIG. 16 when the cam groove bar 134 is in "RAISE" position faces 166 and 170 will have grooves engaged with rollers 150. When the cam groove bar 134 is rotated to "LOWER" position then faces 164 and 168 will have grooves engaged with rollers 150. In order to allow for rotation of bar 134 and maintenance of engagement of rollers 152, turning slots 176 are provided at one end of grooves 162 as shown in FIG. 18.

It will be noted that the parallel grooves 162 in each face of cam groove bar 134 are joined at their ends by angled transfer sections 178 which provide at least one side wall as means for shifting or guiding a roller follower from one groove to the other at the end of its travel. This shifting from one groove to the other occurs when the direction of travel of the cam bar relative to the follower changes, which will be as ram 52 changes from retraction to extension or vice versa with respect to hydraulic cylinder 48. While a roller 152 is travelling the normal length of a groove 162 in a face of ram groove bar 134 it is maintained locked in this groove by the position of cam 160 with its high spot 161 on one side of pivoted arm end 159. However, when the roller nears the end of its lengthwise travel it is forced over by the side wall transfer section 178 which it encounters, and into alignment with the other groove in the cam gooove face. When it is so forced into alignment with the other groove, its holder 154 and cam 160 on its inner end is forced over so that high spot 161 now lies on the other side of arm end 159 which holds it in this position for the reverse travel stroke. Thus automatic means are provided for keeping a cam following roller in a double groove, following one groove in one direction and the other groove in the reverse direction. This is an important feature of the jack control because it provides a cam and follower system in which one sequence of follower activations can be programmed for travel of the follower roller in one direction, and another sequence of follower actuations for the other direction. Thus the actions of the latch bars 74 and 76 can be programmed for engagement and disengagement of their pins with chains 40 at the best and most advantageous positions of these latches with respect to the chain links both on the upstroke and downstroke (extension and retraction) of ram 52 and also with the cam groove bar set in either the "RAISE" or "LOWER" position.

Assuming a cam groove bar 134 as illustrated in FIG. 16 at the bottom of a "RAISE" stroke with rollers 152 engaging groove 162*a* in face 166 and groove 162*b* in face 170, roller 152 in groove 162*a* actuates a valve 144 to control action of ram head latch bars 74 while roller 152 in groove 162B actuates a value 146 to control action of ram base latch bars 76. The roller in groove 162*a* causes the ram head latches to remain engaged with the chain (by reason of roller 152 riding the low area of the cam) until the upper end of a ram stroke is reached, and the roller 152 in groove 162*b* causes the base latches to become disengaged with the chain until the top of the stroke is reached, then the roller drops from the high cam level to the low cam level as it is shifted to groove 162*c* causing the base latches to engage the chains. At the same time the roller in groove 162*a* is shifting over to groove 162*d.* When the ram 52 starts to retract the roller in groove 162*d* is forced to the high level thus maintaining the ram head latches disengaged from the chains during the ram retraction stroke. Just before the end of the ram downstroke the roller in groove 162*d*, which has been on the high cam level to keep the base latches disengaged with the chain, is lowered to a low cam level to cause engagement of the base latches with the chains prior to another upstroke. The roller in groove 162*c*, meanwhile, has shifted over again to groove 162*b* at the bottom of the ram stroke and after it has started up again is shifted from low to high cam level to release the ram head latches from the chains while the rams are being extended and the ram heads raised. It will be noted that the overlapping engagement of at least one of the base or ram head latches at all times provides an advantageous safety factor.

Reverting again to FIG. 7 the jack cylinder hydraulic system is illustrated schematically. Oil line 180 is connected into each of the jack ram operating cylinders 48 above their pistons 50, and oil line 182 is connected into each of cylinders 48 below their pistons 50. These two oil lines are connected to 4-way 3-position valve 184, the other connections to valve 184 being from oil pump 186 and oil reservoir 188 as shown. Valve 184 may be set in right hand position to connect pump 186 with oil line 182 to provide pressurized oil to cylinders 48 to raise pistons 50, the oil from above pistons 50 being returned through oil line 180, through valve 184 and to reservoir 188. This will provide a raise stroke to raise the jack rams simultaneously. When pistons 50 reach the end of their raise strokes, valve 184 is set in left hand position to connect pump 186 with oil line 180 thereby to provide pressurized oil to cylinders 48 above their pistons 50 with the oil from below pistons 50 now being returned through oil line 182 to reservoir 188. This will provide a forcible lower stroke to lower all the jack rams simultaneously. At the end of the lower stroke valve 184 is again changed from left hand to right hand position and this cycle repeated to cause repetitive raising and lowering of the jack rams. If desired, automatic controls may be employed to actuate valve 184 to obtain the desired repetitive raise and lower travel of the jack rams. In addition, conventional "over center" or flow control valves may be employed to maintain constant oil pressure in the oil lines if these are of considerable length. Controlled operation of the upper and lower latch plates of the chain jacks may be provided by oil lines 190 and 192 connected to cable actuating hydraulic cylinders 104 and 106 respectively as shown from valves 144 and 146 inside master jack box 130. Additional lines 194 from pump 196, and line 198 to reservoir 200, which supplies pump 196 through line 202, are also connected to valves 144 and 146 inside box 130 to supply pressurized oil to either the right of right hand piston of cylinder 104 or to the left of the left hand piston of cylinder 106 as directed by travel of rollers 152 in the appropriate grooves in cam bar 134.

Since cables 80 and 84 are tensioned when actuating latches 74 and 76, to which they are attached by clamps 82 and 86, they should be prestressed before the latches are clamped at proper locations for appropriate latch movement. This may be accomplished by first loosening all clamps 82 and 86 then positioning cables 80 and 84 at the ends of their travel by appropriate energization of hydraulic cylinders 104 and 106. Latches 70 and 74 are placed in proper position either extended or retracted with respect to latch plates 44 and 46. Then, with cables still under tension, clamps 82 and 86 are securely fastened to cables 80 and 84.

In operation of the ship lifting apparatus of this invention, platform 26 is assumed to be in lowered position in slip 22. A ship or vessel 28 is floated into the slip over cradle 30. The latch mode control lever 138 is placed in "RAISE" position thus bringing the grooves in faces 166 and 170 into contact with latch actuating followers 152. Valve 184 is moved to left hand position and pressurized oil is introduced simultaneously into all the hydraulic cylinders of jacks 32 and 32*a* below their pistons 50. At the same time latches in upper latch plate 46 are engaged with the links of chains 40 while latches in the lower or base latch plate 44 are disengaged. When rams 52 reach the top of their strokes, the operator changes valve 184 to right hand position and at this time latches in lower latch plate 44 have been engaged with chains 40 while latches in upper latch plate have been disengaged by the action of cam followers 152 riding in grooves of cam bar 134 in master jack control box 130. The rams of the jacks are then lowered to the bottoms of their strokes, the latches are engaged for a return upward stroke of rams 52 and the cycle repeated. As platform 26 rises by lifting action of chains 40, vessel 28 is raised when its cradle 30 rises to support its hull. It will be seen that the chain jack latches are all synchronized in their engagements and disengagements with the lifting chains by simultaneous movement imparted to latch bars 74 and 76 by tensioned cables 80 and 84. Thus the load of the platform, cradle and vessel is lifted by increments evenly along its length and on both sides.

After the platform 26 has been raised sufficiently to enable required work to be accomplished on vessel 28, operation of jacks 32a and 32 may be shut down and the platform 26 and ship or load will remain safely suspended by engagement of at least one of the sets of latches in each jack with its pair of chains. This latch engagement provides a positive safety braking system to hold the weight of the platform and vessel suspended. When it is desired to refloat the vessel, latch control handle 138 is moved to "LOWER" position and valves 182 and 186 are operated again to impart repetitive reciprocal movement of the ram 52 of each jack with respect to its base 34. At the same time jacks 168 and 178 of cam bar 134 will present cam grooves for travel of followers 152 which will actuate the latches for programmed lowering. When platform 26 has been sufficiently lowered, vessel 28 can be refloated.

The ship lifting apparatus of this invention employs chain jacks to provide a strong, reliable and long lasting raising and lowering system. Chain is much stronger than wire rope over a long period of time and is less likely to stretch which could destroy uniform lifting. Positive synchronization of the actions of the jacks is obtained by link engaging latch mechanisms connected by tensioned cables. Since these cables are stressed and always under tension they remain as reliable latch actuators without dimension change. The chain link engaging latches provide completely safe and positive locking of the suspension system to replace or act as a brake. The safety latch bar control ensures that at least one set of latches is in engagement with the chain links at all times.

We claim:

1. Ship lifting apparatus comprising a pair of parallel, spaced apart piers defining a slip, a platform in said slip adapted to support a vessel, and means attached to said piers for raising and lowering said platform; in which the improvement comprises:

a. a plurality of chain jacks mounted in an aligned row on each of said piers and having the ends of their raising and lowering chains attached to said platform;

b. said chain jacks each having a base and a hydraulic cylinder for moving a ram repetitively and reciprocally with respect to said base, and having latches operatively attached to said base and to said ram for engaging and disengaging links of said chains;

c. one of said jacks having means for controlling operation of said latches of said jack at predetermined relative positions of its ram and its base;

d. stressed cables for connecting the latches of said one of said jacks with the latches of the others of said jacks, whereby said one of said jacks becomes a master jack and the others of said jacks become slave jacks; and, e. means for simultaneously introducing pressurized fluid into the hydraulic cylinders of said jacks to cause simultaneous reciprocal movement of the rams of said jacks with respect to their bases and means for actuating said tensioned cables thereby to produce simultaneous operation of said latches resulting in progressive raising and lowering of the chains of said jacks and corresponding raising and lowering of said ship supporting platform.

2. Apparatus according to claim 1 in which said jacks each have a pair of chains, the top free end of each of said chains passing over a sheave rotatably mounted on the head of the ram of said jack.

3. Apparatus according to claim 1 in which each of said jacks has chain engaging latches comprising a pair of parallel spaced apart pins slidably mounted in a pair of horizontal bores in each of a pair of latch plates, one of said latch plates attached to the head of the ram of said jack and the other attached to the base of said jack.

4. Apparatus according to claim 1 in which said cables connecting said latches of said jacks are maintained under tension by a hydraulic spring.

5. Apparatus according to claim 1 in which one pair of stressed cables is connected to ends of latch bars of latches attached to said rams of said jacks and the other pair of stressed cables is attached to the ends of latch bars of latches attached to said bases of said jacks.

6. Apparatus according to claim 5 in which the ends of said cables attached to said ram latch bars and the ends of said cables attached to said base latch bars can each selectively mate with an indentation near an end of a rocker arm pivotably attached at its center to a fixed support, thereby to prevent more than one of said ends of said cables being positioned so that more than one of said ram and said base latches are disengaged from said chain at any time.

7. Apparatus according to claim 1 in which the means for controlling operation of said latches comprise a cam attached to one of said ram and said base of said jack and a follower attached to the other of said ram and said base of said jack.

8. Apparatus according to claim 1 in which the cam of said master jack comprises a bar with grooves in its faces in which followers ride.

9. Apparatus according to claim 8 in which said cam bar is of square cross section and is longitudinally rotatable to present selectively grooves in diametrically opposite faces to a pair of followers for raise and lower modes of operation.

10. Apparatus according to claim 9 in which said grooves in each of said faces comprise a pair of parallel spaced apart grooves joined at each end by angled transfer sections.

11. Apparatus according to claim 10 in which the cam depths of said grooves are different in each of said pairs of grooves to provide different follower action in said grooves.

12. Apparatus according to claim 11 in which means are provided for guiding each of said followers in one of said parallel grooves when said follower is travelling relative to said cam bar in one direction, and in the other of said parallel grooves when said follower is travelling relative to said cam bar in the other direction.

* * * * *